US011819123B2

(12) United States Patent
Zhang

(10) Patent No.: US 11,819,123 B2
(45) Date of Patent: Nov. 21, 2023

(54) MULTIFUNCTIONAL PICNIC TABLE WITH DINNER PLATES

(71) Applicant: Zhihang Zhang, Shenzhen (CN)

(72) Inventor: Zhihang Zhang, Shenzhen (CN)

( * ) Notice: Subject to any disclaimer, the term of this patent is extended or adjusted under 35 U.S.C. 154(b) by 0 days.

(21) Appl. No.: 18/080,791

(22) Filed: Dec. 14, 2022

(65) Prior Publication Data

US 2023/0110174 A1 Apr. 13, 2023

(51) Int. Cl.

*A47B 37/04* (2006.01)
*A47B 3/12* (2006.01)
*A47B 3/10* (2006.01)

(52) U.S. Cl.

CPC ..... *A47B 37/04* (2013.01); *A47B 3/10* (2013.01); *A47B 3/12* (2013.01); *A47B 2220/0069* (2013.01); *A47B 2220/0088* (2013.01)

(58) Field of Classification Search

CPC .. A47B 37/04; A47B 3/10; A47B 3/12; A47B 2220/0088; A47B 13/16
USPC ..... 108/115, 34, 38, 25, 35, 91, 90
See application file for complete search history.

(56) References Cited

U.S. PATENT DOCUMENTS 873,855 A * 12/1907 Goldin ..... A45C 9/00 190/18 R
1,235,097 A * 7/1917 Berg ..... A47B 3/10 144/285
2,517,681 A * 8/1950 Koerper ..... A61G 13/105 5/613
2,693,258 A * 11/1954 Fleisch ..... A47B 3/10 190/11
2,827,352 A * 3/1958 Boyajian ..... A47B 3/10 D21/900
3,394,666 A * 7/1968 Pearlman ..... A47B 3/10 108/135
4,437,714 A * 3/1984 Struck ..... A47B 69/00 312/272
4,887,536 A * 12/1989 Teichner ..... A47B 3/10 108/38
5,009,170 A * 4/1991 Spehar ..... A47B 3/10 108/132
5,400,719 A * 3/1995 Santapa ..... A47B 87/0223 D6/675.3
5,881,653 A * 3/1999 Pfister ..... A47B 87/0223 211/188
6,155,530 A * 12/2000 Borgen ..... H04R 1/026 248/633
7,516,704 B2 * 4/2009 Snider ..... B44D 3/126 312/258
8,215,245 B2 * 7/2012 Morrison ..... H04R 1/026 211/151
8,245,650 B1 * 8/2012 McKsymick ..... A47B 37/02 108/26
8,490,551 B1 * 7/2013 Wagner ..... F25D 3/06 312/229

(Continued)

*Primary Examiner* — Jose V Chen
(74) *Attorney, Agent, or Firm* — Zhigang Ma

(57) ABSTRACT

The present disclosure discloses a multifunctional picnic table with dinner plates, including a left table board and a right table board which are hinged with each other; at least two detachable first table legs and detachable second table legs are mounted on upper and lower end surfaces of both the left table board and the right table board; the first table legs and the second table legs can be spliced end to end and extend; at least one first groove is formed in the upper end surfaces of the left table board and the right table board; and chopping board surfaces are arranged on the lower end surfaces of the left table board and the right table board.

10 Claims, 6 Drawing Sheets

(56) References Cited

U.S. PATENT DOCUMENTS

| | | | | |
|---|---|---|---|---|
| 9,247,807 | B1 * | 2/2016 | Sanchez | A47B 37/04 |
| 9,706,839 | B2 * | 7/2017 | Dilmaghani | A47B 87/0246 |
| 9,770,096 | B1 * | 9/2017 | Meyer | A47B 3/10 |
| 10,092,099 | B1 * | 10/2018 | Linari | A47B 61/04 |
| 10,117,513 | B1 * | 11/2018 | Tolentino | A47B 31/04 |
| 10,130,166 | B1 * | 11/2018 | Prokopovich | B65D 33/14 |
| 11,083,293 | B2 * | 8/2021 | Davis | A47B 47/0083 |
| 2004/0070235 | A1 | 4/2004 | Gregory | |
| 2006/0181114 | A1 | 8/2006 | Nye et al. | |
| 2006/0254480 | A1 * | 11/2006 | Haimoff | B25H 1/10 108/91 |
| 2008/0022904 | A1 * | 1/2008 | Matheus | A47B 3/10 108/38 |
| 2008/0072802 | A1 * | 3/2008 | de Oliveira | A47B 3/10 108/12 |
| 2008/0149802 | A1 * | 6/2008 | Chiang | A47B 3/083 248/463 |
| 2008/0168931 | A1 * | 7/2008 | Wang | A47C 7/62 297/452.48 |
| 2011/0156451 | A1 | 6/2011 | Chen | |
| 2012/0237142 | A1 * | 9/2012 | Derkoski | A47B 3/12 108/157.1 |
| 2014/0102337 | A1 * | 4/2014 | Ralph | A47B 13/16 108/42 |
| 2016/0015177 | A1 * | 1/2016 | Blake | A47B 87/02 108/156 |
| 2016/0183702 | A1 * | 6/2016 | Elze | A47C 7/62 297/219.1 |
| 2019/0318663 | A1 * | 10/2019 | Ortiz | A47B 3/12 |
| 2022/0142354 | A1 * | 5/2022 | Narke | A47B 3/083 |

* cited by examiner

MULTIFUNCTIONAL PICNIC TABLE WITH DINNER PLATES

TECHNICAL FIELD

The present disclosure relates to the technical field of tables, in particular to a multifunctional picnic table with dinner plates.

BACKGROUND

As is well-known, with the improvement of people's living standards, picnicking has become a common way of gathering and dining in daily life. It is necessary to prepare a variety of tools, such as ovens, tables, cutting boards, dinner plates, and tableware.

At present, due to the gradual population of cars, more and more people like to go out for independent travel or picnic. For those who like to go to a picnic, they need to carry too much tableware which also take up a space in the car. These tablewares are large in volume and heavy, and it is not convenient for users to carry and use them. As a result, there are some folding picnic tables on the market, which only have the function of a simple folding table. The function is monotonous, and the table also has a large volume after being folded, which is not convenient for users to actually carry and use. For example, Chinese utility model patent No. CN202122298984.4 discloses a folding picnic table.; There are also folding chopping boards on the market For example, Chinese utility model patent No. CN202023160767.0 discloses a disposable folding chopping board for picnic. Although it can be folded and carried easily, the chopping board has a simple function and is not environmentally friendly, and the cost of users is also high. Therefore, the above defects are significant. Therefore, a multifunctional picnic table with dinner plates.

SUMMARY

For the shortcomings in the prior art, the present disclosure aims to provide a multifunctional picnic table with dinner plates.

In order to achieve the above objective, the present disclosure adopts the following technical solution:

A multifunctional picnic table with dinner plates includes a left table board and a right table board which are hinged with each other, wherein at least two detachable first table legs are mounted on upper and lower end surfaces of both the left table board and the right table board; detachable second table legs are mounted on the upper end surface or the lower end surface of the left table board or the right table board and located between the first table legs of the left table board and the first table legs of the right table board; the first table legs and the second table legs are spliced end to end and extend; at least one first groove is formed in the upper end surfaces of the left table board and the right table board; and chopping board surfaces are arranged on the lower end surfaces of the left table board and the right table board.

Preferably, at least two detachable hooks are mounted on two sides of the left table board and the right table board: and the lower end surfaces of the left table board and the right table board are hooked with net bags, through the hooks.

Preferably, a cover is arranged at an entire periphery of the upper end surfaces of the left table board and the right table board.

Preferably, the left table board and the right table board are connected through hinges; positioning slots are formed in hinged portions, located between the left table board and the right table board, on the upper end surfaces of the left table board and the right table board; and fixing sheets of the hinges are embedded into the positioning slots.

Preferably, one end of each of the first table legs and second table legs is provided with a stud, and the other end is provided with a screw hole matched with the stud; and screw holes matched with the studs are formed in the upper and lower end surfaces of both the left table board and the right table board.

Preferably, side surfaces of the mutually folded left table board and right table board are locked by lock catches, and a handle is arranged on the left table board or the right table board.

Preferably, at least two second grooves for placing forks, chopsticks and spoons are arranged on the upper end surfaces of the left table board and the right table board; magnets are arranged at bottoms of the second grooves; and a fastening position is arranged between two of the second grooves.

Preferably, drawers are mounted on side surfaces of the left table board and the right table board; and third grooves are arranged in the drawers.

Preferably, the left table board and the right table board are made of a bamboo material, and antiskid pads are arranged at bottoms of the first table legs and the second table legs.

Preferably, outer surfaces of both the left table board and the right table board are coated with varnish.

By the adoption of the above solutions, compared with the prior art, the present disclosure has the following significant advantages and beneficial effects:

1. The left table board and the right table board are hinged to each other. The detachable first table legs and second table legs are mounted on the upper and lower end surfaces of both the left table board and the right table board, and the chopping board surfaces are arranged on the lower end surfaces. Therefore, when the left table board and the right table board are unfolded, after the first table legs and the second table legs are mounted on the chopping board surfaces of the left table board and the right table board, since the upper end surfaces of the left table board and the right table board are provided with the first grooves, a table with dinner plates is formed, and food is accommodated in the first grooves for dining. The left table board and the right table board are turned upside down. The first table legs and the second table legs are mounted on the surfaces of the left table board and the right table board provided with the first grooves. At this time, the chopping board surfaces are upward to form a table with chopping boards. Furthermore, when not in use, the entire table can be folded together, and the first table legs and the second table legs are removed and stored in the first grooves which can also accommodate spoons, chopsticks and other tablewares, so that the storage volume is effectively reduced. Users do not need to carry tablewares, a chopping board and a table when going out for a picnic. It is convenient for users to carry and use the picnic table when the users go out for a picnic.

2. The lower end surfaces of the left table board and the right table board are hooked with net bags through the hooks, and a cover is arranged at an entire periphery of the upper end surfaces. Therefore, in use, food materials or garbage can be placed in the net bags. When the left table board and the right table board are unfolded for use, the cover can keep the left table board and the right table board out of rainwater and insects, so that the picnic table has various use functions. Furthermore, this device can be spliced and used for many times after being cleaned, which is energy-saving and environmentally-friendly, so that the use cost of the user is effectively reduced, and the user can actually use the picnic table conveniently.

3. The drawers are mounted on the side surfaces of the left table board and the right table board, so that condiment bottles or other tools can be placed in the drawers. The net bags and the cover can all be stored in the drawers after being folded, which facilitates actual storage and use. Therefore, the picnic table with the dinner plates greatly meets the actual use needs of the user because of its various practical functions. The picnic table with the dinner plates has a simple structure, is convenient to assemble and disassemble, and has extremely high practicability.

Figure 1:
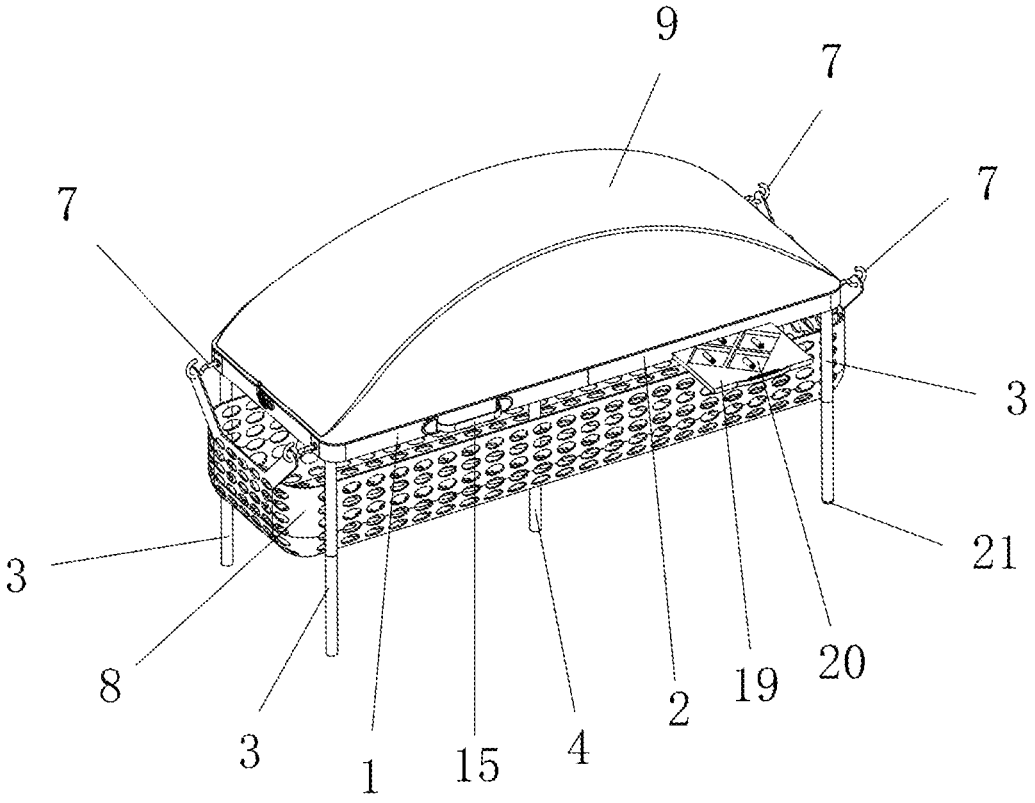
FIG. 1 is an axonometric diagram according to an embodiment of the present disclosure.

1: left table board; 2: right table board; 3: first table leg; 4: second table leg; 5: first groove; 6: chopping board surface; 7: hook; 8: net bag; 9: cover; 10: hinge; 11: positioning slot; 12: stud; 13: screw hole; 14: lock catch; 15: handle; 16: second groove; 17: magnet; 18: fastening position; 19: drawer; 20: third groove; and 21: antiskid pad.

DETAILED DESCRIPTION OF THE EMBODIMENTS

The embodiments of the present disclosure are described in detail below in combination with the accompanying drawings. However, the present disclosure can be implemented in various different ways defined and covered by the claims.

In the description of the present disclosure, it should be understood that orientations or positional relationships indicated by the terms "center", "longitudinal", "transverse", "length" "width", "thickness", "upper end", "lower end", "front", "rear", "left", "right", "vertical", "horizontal", "top", "bottom", "inside", "outside", "clockwise", "anticlockwise", and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are not construed as limiting the present disclosure. In addition, the terms "first" and "second" are used for descriptive purposes only and are not to be understood to indicate or imply relative importance or to imply the number of indicated technical features. Therefore, features defined by "first" and "second" can explicitly instruct or impliedly include one<or more features. In the description of the present disclosure, unless expressly specified otherwise, the meaning of the "plurality" is two or more than two.

In the description of the present disclosure, it should be further noted that unless otherwise explicitly specified and defined, the terms "mounted", "coupled" and "connected" shall be understood broadly, and may be, for example, fixedly connected, or detachably connected, or integrally connected. It may be mechanical connection or electric connection. It may be direct connection, connection via an intermediate, internal communication of two elements, or interactive, relationship of two elements. For those of ordinary skill in the art, the specific meanings of the above terms in the present, disclosure can be understood according to specific situations.

As shown in FIG. 1 to FIG. 6, a multifunctional picnic table with dinner plates provided by this embodiment includes a left table board 1 and a right table board 2 which are hinged with each other. At least two detachable first table legs 3 are mounted on upper and lower end surfaces of both the left table board 1 and the right table board 2. Detachable second table legs 4 are mounted on the upper end surface or the lower end surface of the left table board 1 or the right table board 2 and located between the first, table legs 3 of the left table board 1 and the first table legs 3 of the right table board 2. The second table legs 4 are used as intermediate supporting legs between the left table board 1 and the right table board 2. The first table legs 3 and the second table legs 4 can be spliced end to end and extend. At least one first groove 5 is formed in the upper end surfaces of the left table board 1 and the right table board 2. Chopping board surfaces 6 are arranged on the lower end surfaces of the left table board 1 and the right table board 2.

Figure 2:
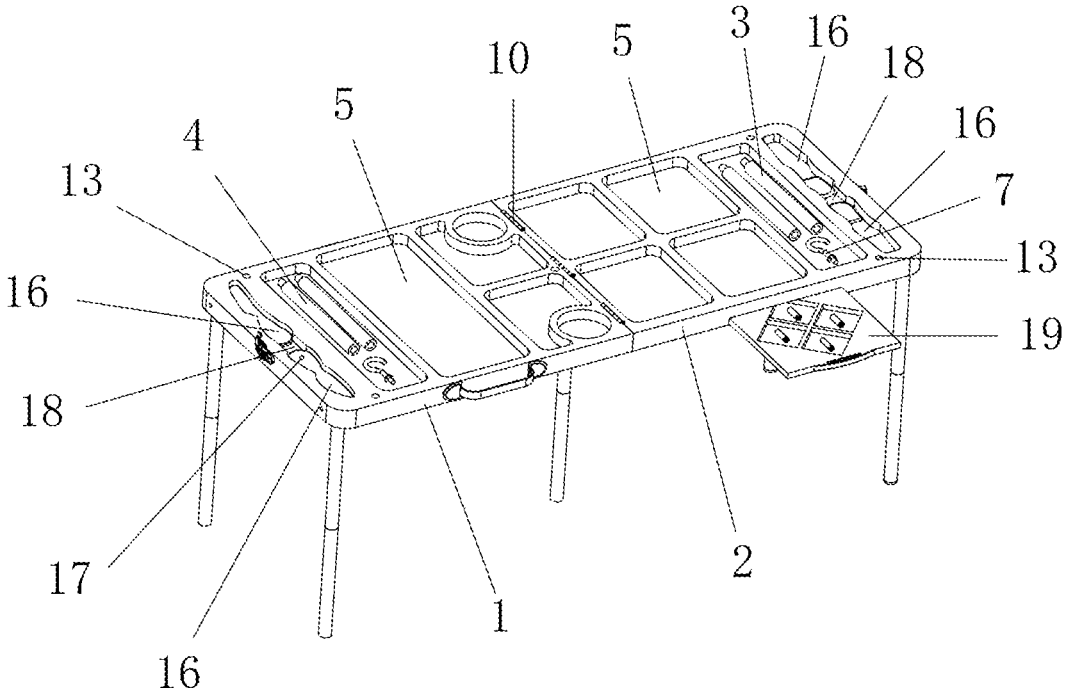
FIG. 2 is a schematic structural diagram of a picnic table with dinner plates according to an embodiment of the present disclosure.
Figure 3:
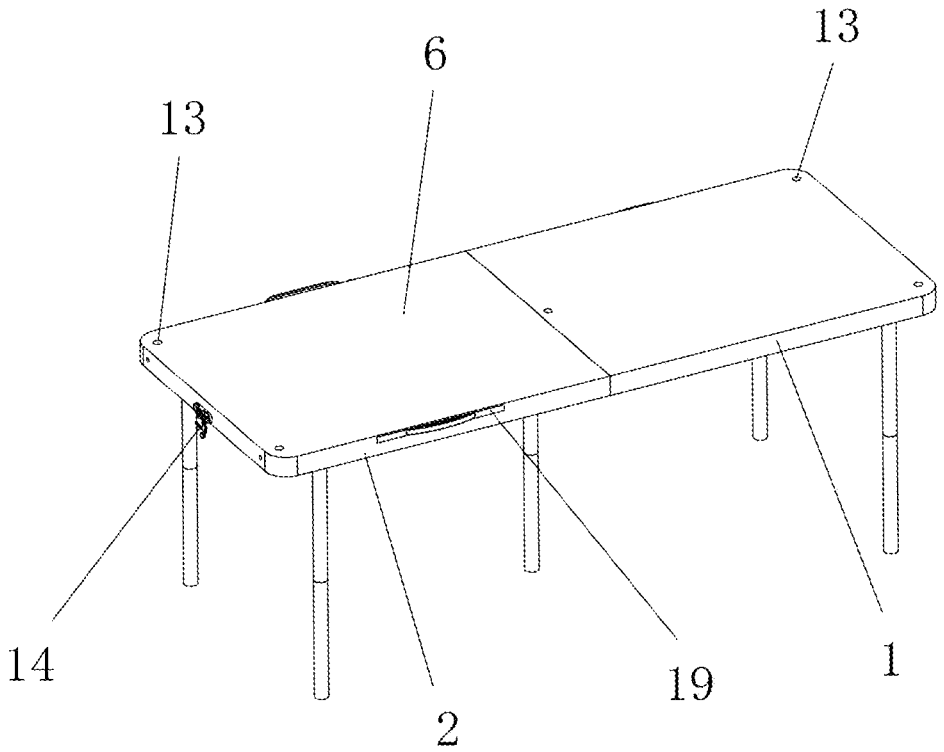
FIG. 3 is a schematic structural diagram of a picnic table with chopping boards according to an embodiment of the present disclosure.
Figure 4:
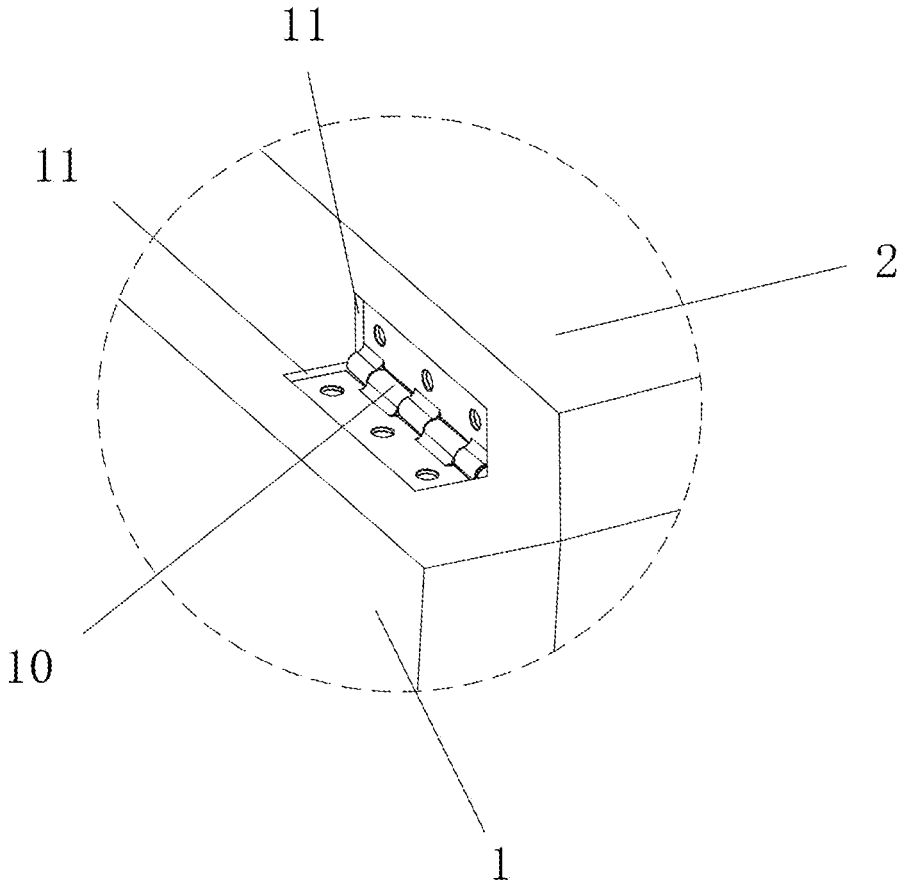
FIG. 4 is a schematic structural diagram of mounting hinges according to an embodiment of the present disclosure.
Figure 5:
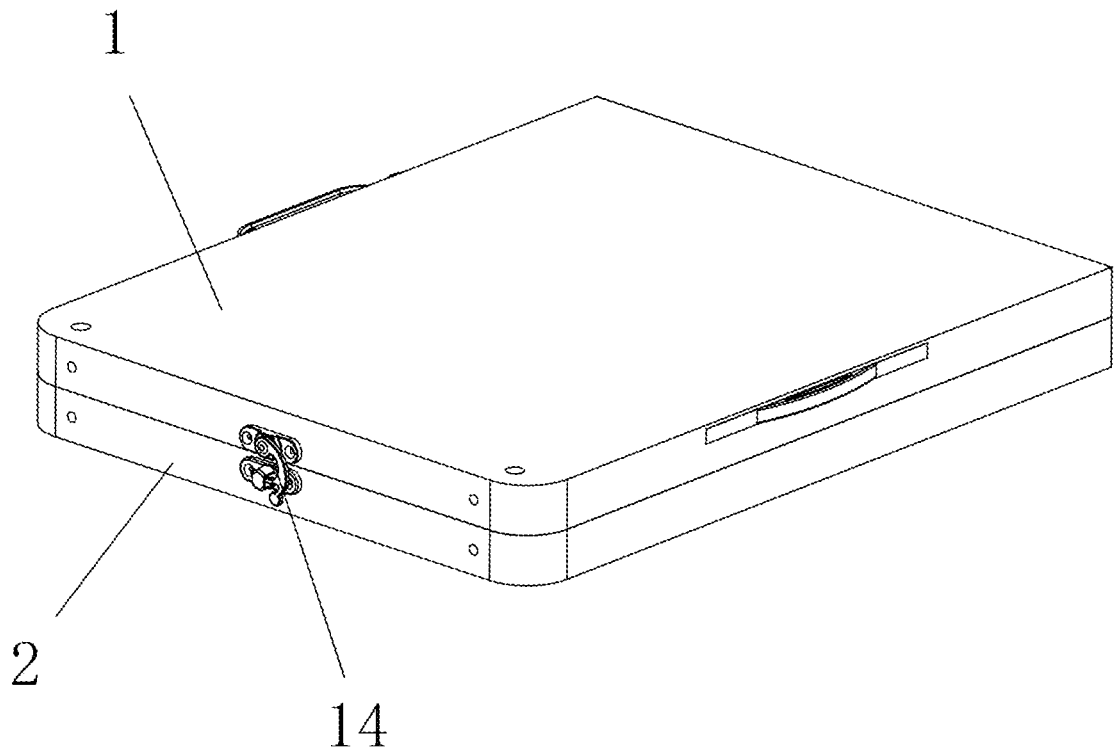
FIG. 5 is a schematic structural diagram of a folded state according to an embodiment of the present disclosure.
Figure 6:
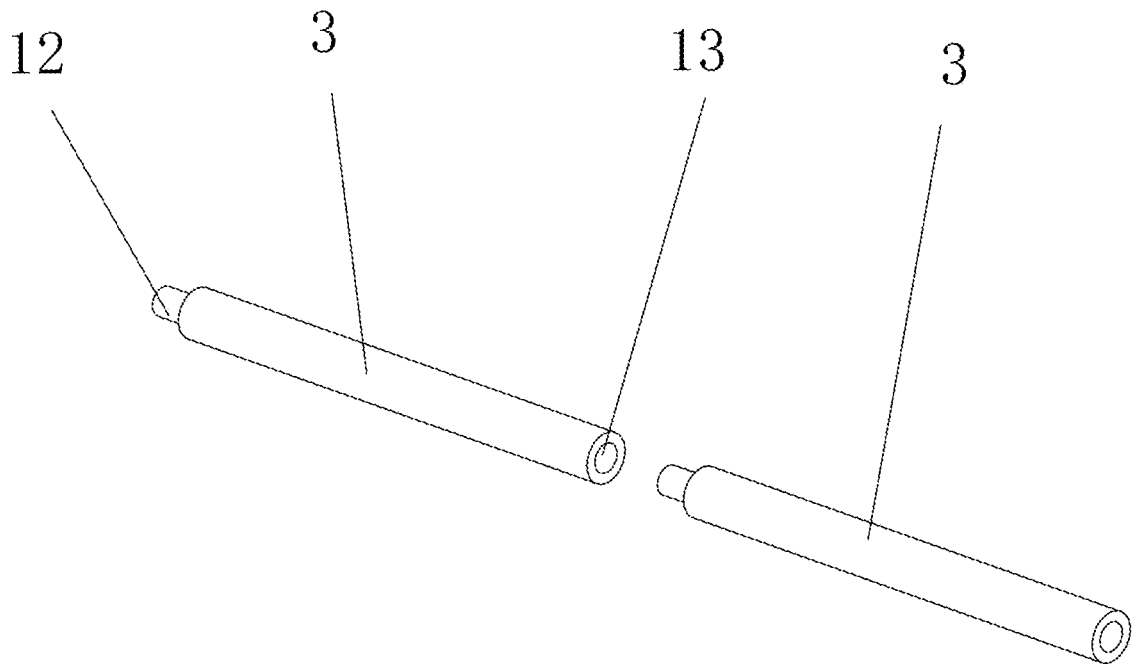
FIG. 6 is a schematic structural diagram of connecting first table legs according to an embodiment of the present disclosure.

In this embodiment, during actual use, the several first table legs 3 and second table legs 4, hooks 7, net bags 8 and a cover 9 are all stored in the first grooves 5; the left table board 1 and the right table board 2 are folded together, thus reducing the storage volume and facilitating a user to carry and use the picnic table when the user goes out for a picnic. When the picnic table needs to be used outside, the user first rotatably opens the left table board 1 and the right table board 2 to form a plane. When the user needs to use a chopping board, the first table legs 3 and the second table legs 4 are in turn mounted on the surfaces of the left table board 1 and the right table board 2 provided with the first grooves 5. At this time, the chopping board surfaces 6 are upward, and a table with chopping boards is formed (as shown in FIG. 3). When used at home, the picnic table can also be used as a study desk or a computer desk for children. When the user needs to use dinner plates, the first table legs 3 and the second table legs 4 are in turn mounted on the chopping board surfaces 6 of the left table board 1 and the right table board 2. At this time, the first grooves 5 are upward, and the user can put food materials, seasoning and the like into the first grooves 5. Therefore, a table with dinner plates is formed and can be used outdoor (as shown in FIG. 2) or at home. In addition, a grill can be placed on the surfaces of the left table board 1 and the right table board 2, so that the user can cook outside, Therefore, the picnic table has various practical functions and effectively meets the actual use needs of the user.

Further, at least two detachable hooks 7 are mounted on two sides of the left table board 1 and the right table board 2. The lower end surfaces of the left table board 1 and the right table board 2 are hooked, with net bags 8 through the hooks 7. Therefore, in use, the net bags 8 can accommodate food materials, garbage or other objects, which facilitates actual use.

Further, a cover 9 is arranged at an entire periphery of the upper end surfaces of the left table board 1 and the right table board 2. The cover 9 is fixed by the hooks 7. Therefore, when food or food materials are placed on the chopping board surfaces 6 or in the first grooves 5, the cover 9 can keep the left table board 1 and the right table board 2 out of rainwater and insects, which facilitates the user to go out for a picnic.

Further, the left table board 1 and the right table board 2 of this embodiment are connected through hinges 10. Positioning slots 11 are formed in hinged portions, located between the left table board 1 and the right table board 2, on the upper end surfaces of the left table board 1 and the right table board 2. Fixing sheets of the hinges 10 are embedded into the positioning slots 11. Therefore, the fixing sheets of the hinges 10 are embedded into the positioning slots 11, so that the, fixing sheets of the hinges 10 are prevented from protruding from the side surfaces of the left table board 1 and the right table board 2. When the left table board 1 and the right table board 2 are unfolded into a plane through the hinges 10, connection surfaces between the left table board 1 and the right table board 2 can be in tight fit, so that the space between the left table board 1 and the right table board 2 is extremely small. The entire chopping board surface 6 formed after the left table board 1 and the right table board 2 are unfolded nearly has no slits or grooves (as shown in FIG. 3), and is very flat, which effectively prevents small food materials from falling into the space between the left table board 1 and the right table board 2 during cutting of food materials.

Further, one end of each of the first table legs 3 and second table legs 4 of this embodiment is provided with a stud 12, and the other end is provided with a screw hole 13 matched with the stud 12. Screw holes 13 matched with the studs 12 are formed in the upper and lower end surfaces of both the left table board 1 and the right table board 2. Therefore, the first table legs 3 and the second table legs 4 can be screwed and fixedly assembled end to end through the studs 12 and the screw holes 13 at the two ends of the first table legs 3 and the second table legs 4 and extend. The table legs are screwed and fixedly mounted in the screw holes 13 on the upper and lower end surfaces of the left table board 1 and the right table board 2 through the studs 12. The user can easily mount the table legs and can freely increase the heights of the left table board 1 and the right table board 2 by prolonging the lengths of the first table legs 3 and the second table legs 4, so as to match the usage state. Therefore, the user can use the picnic table standing or sitting by means of adjusting the heights of the first table legs 3 and the second table legs 4, and the picnic tables can also be used by people in different heights. After the detachable first table legs 3 and second table legs 4 are disassembled, the lengths of the table legs are also effectively reduced, so that for storage, the first table legs 3 and the second table legs 4 can be removed in turn and stored in the first grooves 5, facilitating actual use.

Further, side surfaces of the mutually folded left table board 1 and right table board 2 of this embodiment are locked by lock catches 14, and a handle 15 is arranged on the left table board 1 or the right table board 2. Therefore, by means of the arrangement of the, lock catches 14, the folded left table board 1 and right table board 2 are effectively prevented from being suddenly unfolded. It is convenient for the user to carry and use the picnic table when the user goes out for a picnic. Meanwhile, due to the handle 15, the user can hold and move the picnic table as a whole conveniently.

Further, at least two second grooves 16 for placing forks, chopsticks and spoons are arranged on the upper end surfaces of the left table board 1 and the right table board 2. Magnets 17 are arranged at bottoms of the second grooves 16. A fastening position 18 is arranged between two of the second grooves 16. Therefore, ferro-magnetic forks, chopsticks, knives and spoons can be put in the second grooves 16 and are attracted by the magnets 17 at the bottoms of the second grooves 16, so that the forks, the chopsticks, the knives and the spoons in the second grooves 16 are effectively prevented from falling off when the left table board 1 and the right table board 2 are folded. The forks, the chopsticks, the knives and the spoons are firmly attracted in the second grooves 16, so that the tableware is prevented from falling off when the user moves or carries them, which facilitates actual use.

Further, drawers 19 are mounted on side surfaces of the left table board 1 and the right table board 2, and third grooves 20 are arranged in the drawers 19. Therefore, condiment bottles or other tools can be placed in the third grooves 20. The net bags 8 and the cover 9 can be folded and stored in the third grooves 20 of the drawers 19, which facilitates actual storage and use.

Further, the left table board 1 and the right table, board 2 of this embodiment are made of a bamboo material, and antiskid pads 21 are arranged at bottoms of the table legs. By use of the antiskid pads 21, a frictional force can be provided to improve the overall placement stability. Bamboo has the advantages of light weight, high intensity and attractive appearance, so that it is very suitable for being made into tables. The left table board 1 and the, right table board 2 which are made of the bamboo material also have the above advantages.

Further, outer surfaces of both the left table board 1 and the right table board 2 are coated with varnish. Therefore, after the outer surfaces of both the left table board 1 and the right table board 2 are coated with the varnish of a food grade, a dense varnish protective layer is formed on the outer surfaces, so that the outer surfaces of the left table board 1 and the right table board 2 can be effectively prevented from being affected by damp, mildewed, cracked, oxidized and faded, and the overall service life is greatly prolonged.

The above descriptions are only the preferred embodiments of the present disclosure, and are not intended to limit the patent scope of the present disclosure. Any equivalent structure or equivalent process transformation made by using the content of the specification and drawings of the present disclosure and directly or indirectly applied to other related technical fields shall all be similarly included in the scope of patent protection of the present disclosure.

What is claimed is:

1. A multifunctional picnic table with dinner plates, comprising a left table board, a right table board hinged with the first table board, at least two detachable first tale legs, and at least two second table legs, wherein the right table board is rotatable relative to the left table board between a folded state and an unfolded state, wherein in the unfolded state, the at least two detachable first table legs are detachably mounted on upper end surfaces or lower end surfaces of both the left table board and the right table board, and the at least two second table legs are detachably mounted on the upper end surfaces or the lower end surfaces of at least one of the left table board and the right table board and located between the first table legs mounted on the left table board and the first table legs mounted on the right table board; the first table legs and the second table legs are spliced end to end to increase a supporting height of the picnic table; the upper end surfaces of both the left table board and the right table board are recessed to define at least one first groove configured to accommodate the at least two first table legs and the at least two second table legs; and chopping board surfaces are arranged on the lower end surfaces of the left table board and the right table board.

2. The multifunctional picnic table with the dinner plates according to claim 1, wherein at least two detachable hooks are mounted on two sides of the left table board and the right table board; and the lower end surfaces of the left table board and the right table board are hooked with net bags through the hooks.

3. The multifunctional picnic table with the dinner plates according to claim 1, wherein a cover is arranged at an entire periphery of the upper end surfaces of the left table board and the right table board.

4. The multifunctional picnic table with the dinner plates according to claim 1, wherein the left table board and the right table board are connected through hinges; positioning slots are formed in hinged portions, located between the left table board and the right table board, on the upper end surfaces of the left table board and the right table board; and fixing sheets of the hinges are embedded into the positioning slots.

5. The multifunctional picnic table with the dinner plates according to claim 1, wherein one end of each of the first table legs and second table legs is provided with a stud, and the other end is provided with a screw hole matched with the stud; and screw holes matched with the studs are formed in the upper end surfaces and the lower end surfaces of both the left table board and the right table board.

6. The multifunctional picnic table with the dinner plates according to claim 1, wherein in the folded state, side surfaces of the left table board and right table board are locked by lock catches, and a handle is arranged on the left table board or the right table board.

7. The multifunctional picnic table with the dinner plates according to claim 1, wherein the upper end surfaces of the left table board and the right table board are recessed to define at least two second grooves configured to accommodate forks, chopsticks and spoons; magnets are arranged at bottoms of the second grooves; and a fastening position is arranged between adjacent two of the second grooves.

8. The multifunctional picnic table with the dinner plates according to claim 1, wherein drawers are mounted on side surfaces of the left table board and the right table board; and an inner bottom wall of the drawers defines third grooves configured to accommodate condiment bottles or tools.

9. The multifunctional picnic table with the dinner plates according to claim 1, wherein the left table board and the right table board are made of a bamboo material, and antiskid pads are arranged at bottoms of the first table legs and the second table legs.

10. The multifunctional picnic table with the dinner plates according to claim 1, wherein outer surfaces of both the left table board and the right table board are coated with varnish.

* * * * *